US012392213B2

(12) United States Patent
Wilkinson et al.

(10) Patent No.: US 12,392,213 B2
(45) Date of Patent: Aug. 19, 2025

(54) METHOD FOR SETTING A FRAC PLUG WITH A TUBULAR METAL SEAL

(71) Applicant: Paramount Design LLC, Duncan, OK (US)

(72) Inventors: Brian Wilkinson, Duncan, OK (US); Loren Swor, Duncan, OK (US)

(73) Assignee: Paramount Design, LLC, Duncan, OK (US)

( * ) Notice: Subject to any disclaimer, the term of this patent is extended or adjusted under 35 U.S.C. 154(b) by 246 days.

(21) Appl. No.: 17/690,635

(22) Filed: Mar. 9, 2022

(65) Prior Publication Data

US 2022/0290525 A1 Sep. 15, 2022

Related U.S. Application Data

(60) Provisional application No. 63/158,475, filed on Mar. 9, 2021.

(51) Int. Cl.

| | |
|---|---|
| ***E21B 33/128*** | (2006.01) |
| ***E21B 23/06*** | (2006.01) |
| *E21B 33/12* | (2006.01) |

(52) U.S. Cl.

CPC ..... *E21B 33/128* (2013.01); *E21B 23/06* (2013.01); *E21B 33/1208* (2013.01)

(58) Field of Classification Search

CPC ..... E21B 33/128; E21B 23/0414; E21B 23/0417; E21B 33/1291; E21B 33/1293; E21B 23/0412; E21B 23/06; E21B 33/13; E21B 33/12; E21B 33/12955; E21B 33/129

See application file for complete search history.

(56) References Cited

U.S. PATENT DOCUMENTS

| | | | |
|---|---|---|---|
| 3,000,443 | A | 9/1961 | Thompson |
| 4,911,245 | A | 3/1990 | Adamek et al. |
| 5,364,110 | A | 11/1994 | Streich et al. |
| 5,709,269 | A | 1/1998 | Head |
| 6,164,663 | A | 12/2000 | Turner |
| 6,962,206 | B2 | 11/2005 | Hirth et al. |
| 7,168,494 | B2 | 1/2007 | Starr et al. |
| 7,210,533 | B2 | 5/2007 | Starr et al. |

(Continued)

FOREIGN PATENT DOCUMENTS

| | | | | |
|---|---|---|---|---|
| GB | 2569063 | A | 6/2019 | |
| WO | WO 2016/210161 | A1 | 12/2016 | |
| WO | WO 2020086892 | * | 4/2020 | ..... E21B 33/129 |

*Primary Examiner* — Yong-Suk (Philip) Ro

(74) *Attorney, Agent, or Firm* — Hall Estill Law Firm

(57) ABSTRACT

The present disclosure describes systems and methods for setting and sealing a plug in a casing within a downhole bore. This includes deploying into the casing a plug assembly comprising a tubular metal seal and deploying into the casing a setting tool. The tubular metal seal can be expanded radially to a first radial diameter with the setting tool by moving the setting tool longitudinally such that a tapered exterior portion of the first end of the setting tool engages a tapered interior portion of the first end of the tubular metal seal. The setting tool can then be removed from the casing. The method may comprise expanding the tubular metal seal radially to a second radial diameter by pumping fluid into the plug assembly such that the exterior of the tubular metal seal engages an interior of the casing.

18 Claims, 13 Drawing Sheets

(56) References Cited

U.S. PATENT DOCUMENTS

| | | | |
|---|---|---|---|
| 8,459,347 | B2 | 6/2013 | Stout |
| 9,080,439 | B2 | 7/2015 | O'Malley et al. |
| 9,970,248 | B2 | 5/2018 | Hallundbaek |
| 9,976,381 | B2 * | 5/2018 | Martin ..... E21B 23/0413 |
| 2003/0080516 | A1 | 5/2003 | Zheng |
| 2004/0244968 | A1 | 12/2004 | Cook et al. |
| 2013/0333901 | A1 | 12/2013 | Melenyzer |

* cited by examiner

METHOD FOR SETTING A FRAC PLUG WITH A TUBULAR METAL SEAL

CROSS-REFERENCE TO RELATED APPLICATIONS

This application claims priority to the provisional patent application identified by U.S. Ser. No. 63/158,475, filed Mar. 9, 2021, titled "Method for Setting a Frac Plug with a Tubular Metal Seal", the entire contents of which are hereby expressly incorporated herein by reference.

FIELD OF THE DISCLOSURE

The disclosure generally relates to methods and apparatuses for setting downhole plugs, such as for oil and gas production. More particularly the disclosure relates to methods and apparatuses utilizing a tubular metal seal (a flare seal) to set and/or seal a plug, such as a frac plug, in a downhole environment, such as within a casing.

BACKGROUND

The extraction of oil and gas from the ground often involves plugging a drilled hole, either partially or completely, during various phases of the extraction. For example, plugs may be used to temporarily block passage of oil, gas, and/or water on one side of the plug and/or fluids pumped down the drilled hole on the other side of the plug. In some implementations, one or more plugs are used in hydraulic fracturing ("fracking") processes. Such plugs may be referred to as "frac plugs."

Traditional frac plugs are secured downhole using slip systems having one or more cones that are longitudinally moved such that the cones slide under slip segments and expand the slip segments radially (outwardly) toward the casing of the drilled hole, until teeth or buttons on the outside of the slip segments engage the inner diameter of the casing. Typically, these traditional plugs also have an elastomer ring that is expanded radially (outwardly) by the cones' movements caused by the longitudinal compression force. Usually, the slip segments hold the frac plug in place against the casing, while the elastomer rings create a fluid seal such that fluid movement past the outside of the frac plug in the casing is limited or stopped.

However, elastomer rings tend to fail, such as through extrusion, causing leakage around the frac plug and possible total failure of the plug. Elastomer rings typically have a tensile strength of up to 2,500 psi, such that higher pressures and temperatures often cause failure of the elastomer rings. Further, elastomer rings that are designed to be dissolvable are costly and dissolve incompletely, leaving elastomer pieces that can interfere with other downhole equipment and/or operations.

In some cases, metal seals have been used that have been set with longitudinal compression force. Metal seals have conventionally been made of materials that kept a circular shape when expanded. Since many downhole casings have irregularly shaped interiors, that is, not perfectly circular interiors, these conventional circular metal seals are ineffective and do not seal the plug to the interior of the casing and fluid leaks past the plug. Such leakage can cause complete failure of the plug and interfere with downhole operations. What is needed are effective metal seals and methods to set metal seals for frac plugs for sealing the frac plug against the interior of the casing, in a cost effective and time effective manner.

SUMMARY

A method and system for setting a frac plug downhole with a tubular metal seal are disclosed. The problems of ineffective, difficult, and time-consuming setting processes for downhole plugs and of seal failures are addressed through the use of a tubular metal seal that may set and seal a plug in a downhole casing.

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale, or in schematic in the interest of clarity and conciseness. Not every component may be labeled in every drawing. Like reference numerals in the figures may represent and refer to the same or similar element or function. In the drawings.

DETAILED DESCRIPTION

Figure 1:
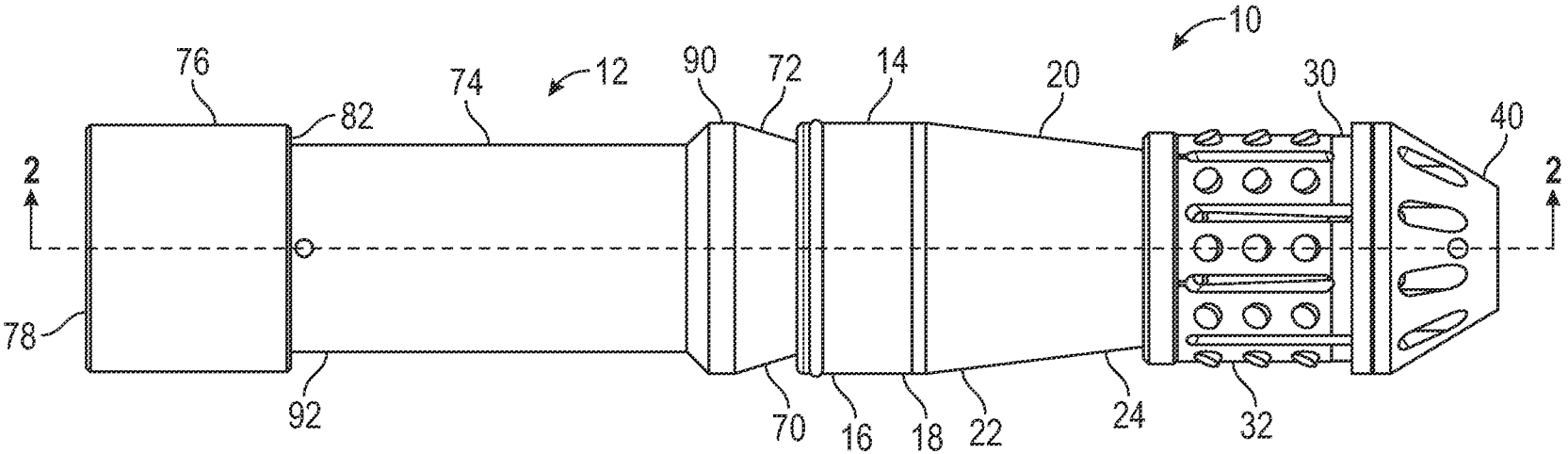
FIG. 1 is a side view of an exemplary plug assembly and an exemplary setting tool, in which the plug assembly is in an initial state, in accordance with the present disclosure.

The following detailed description refers to the accompanying drawings. The same reference numbers in different drawings may identify the same or similar elements.

The mechanisms proposed in this disclosure circumvent the problems described above. The present disclosure describes a method for setting and sealing a plug, such as a frac plug, in a casing within a bore. An exemplary embodiment includes a method comprising deploying a plug assembly into a casing within a drilled hole, the plug assembly comprising a tubular metal seal having an interior, an exterior, a sidewall extending between the interior and the exterior, a proximal end, a distal end, and a length extending between the proximal end and the distal end, the interior at the proximal end having a tapered interior portion extending inwardly toward the distal end along the length; deploying a setting tool into the casing within the drilled hole, the setting tool having a first end having a tapered exterior portion; expanding the tubular metal seal radially to a first radial diameter with the setting tool by moving the setting tool longitudinally such that the tapered exterior portion of the first end of the setting tool engages the tapered interior portion of the proximal end of the tubular metal seal; and removing the setting tool from the casing.

In some implementations, the method may further comprise expanding the tubular metal seal radially to a second radial diameter, such that the exterior of the tubular metal seal engages an interior of the casing, by pumping fluid into the casing, the fluid providing radial pressure against the interior of the tubular metal seal, thereby preventing fluid flow past the exterior of the tubular metal seal in the casing.

In some implementations, expanding the tubular metal seal radially to the first radial diameter and/or the second radially diameter may comprise plastically deforming at least the proximal end of the tubular metal seal with the setting tool and thereby conforming at least the proximal end of the tubular metal seal to the interior of the casing. In some implementations, expanding the tubular metal seal radially to the first radial diameter and/or the second radially diameter may comprise plastically deforming the tubular metal seal and conforming the exterior of the tubular metal seal to the interior of the casing.

In some implementations, the interior of the casing has an irregular shape, and expanding the tubular metal seal radially to the first radial diameter and/or the second radially diameter may comprise expanding the tubular metal seal radially such that the exterior of the tubular metal seal has an irregularly shaped circumference conforming to the irregular shape of the interior of the casing.

In some implementations, the tubular metal seal may have a radial interior groove in the sidewall extending about the interior. In some implementations, the method may comprise expanding the tubular metal seal radially to a first radial diameter and/or a second radial diameter and plastically deforming the sidewall at the radial interior groove of the tubular metal seal, such that the exterior of the tubular metal seal engages an interior of the casing, through use of the setting tool and/or by pumping fluid into the casing to provide radial pressure against the interior of the tubular metal seal, thereby preventing fluid flow past the exterior of the tubular metal seal in the casing.

In some implementations, the first end of the frustoconical tube has a first diameter and the frustoconical tube has a second end having a second diameter smaller than the first diameter, and the plug assembly may further comprise a slip member having one or more slip segments positioned at least partially around the second end of the frustoconical tube; and the method may further comprise moving the frustoconical tube longitudinally within the one or more slip segments by moving the setting tool longitudinally, thereby expanding the one or more slip segments outwardly.

Further, in some implementations, an exemplary plug assembly may comprise a tubular metal seal having an interior, an exterior, a proximal end, a distal end, a length extending between the proximal end and the distal end, and a sidewall extending between the interior and the exterior, the interior having a tapered portion extending inwardly along the length toward the distal end, the interior having a radial interior groove located between the tapered portion and the distal end; and wherein the tubular metal seal is radially expandable to a first radial diameter by moving a setting tool longitudinally such that a tapered exterior portion of a first end of the setting tool engages the tapered portion of the interior of the proximal end of the tubular metal seal, thereby radially deforming the tubular metal seal.

In some implementations of the plug assembly, the tubular metal seal may be radially expandable to a second radial diameter larger than the first radial diameter by pumping fluid into the casing, the fluid providing radial pressure against the interior of the tubular metal seal, thereby further outwardly radially deforming the tubular metal seal, such that the exterior of the tubular metal seal engages an interior of the casing, preventing fluid flow past the exterior of the tubular metal seal in the casing.

In some implementations of the plug assembly, the tubular metal seal may have a radial interior groove extending about the interior, and deforming the tubular metal seal may include deforming at least the tapered portion of the interior of the proximal end and the sidewall at the radial interior groove of the tubular metal seal to conform to the interior of the casing.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more and the singular also includes the plural unless it is obvious that it is meant otherwise.

Further, use of the term "plurality" is meant to convey "more than one" unless expressly stated to the contrary.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

The use of the term "at least one" or "one or more" will be understood to include one as well as any quantity more than one. In addition, the use of the phrase "at least one of X, V, and Z" will be understood to include X alone, V alone, and Z alone, as well as any combination of X, V, and Z.

The use of ordinal number terminology (i.e., "first", "second", "third", "fourth", etc.) is solely for the purpose of differentiating between two or more items and, unless explicitly stated otherwise, is not meant to imply any sequence or order or importance to one item over another or any order of addition.

Finally, as used herein any reference to "one embodiment" or "an embodiment" or "implementation" means that a particular element, feature, structure, or characteristic described in connection with the embodiment is included in at least one embodiment. The appearances of the phrase "in one embodiment" in various places in the specification are not necessarily all referring to the same embodiment. Element, feature, structure, or characteristic described in connection with one implementation may be combined with other implementations, unless expressly described otherwise.

As discussed above, current systems for sealing around plugs, such as frac plugs, in downhole casings are not dependable and are costly. The present disclosure addresses these deficiencies with a methodology for setting a plug in a casing including expanding a tubular metal seal within the casing.

Figure 2:
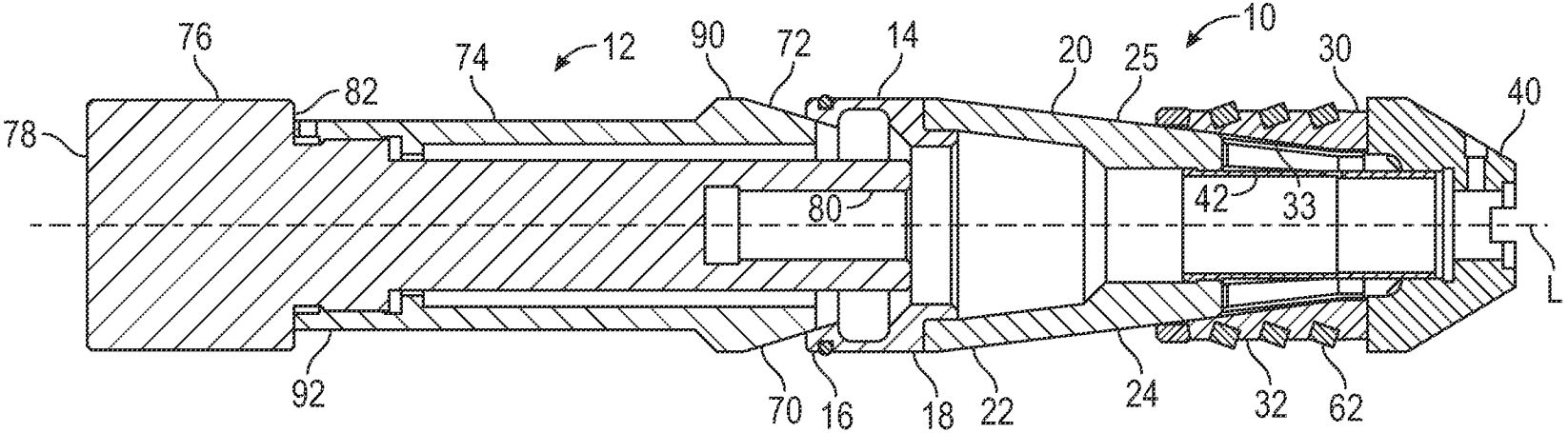
FIG. 2 is a cross-sectional view of the exemplary plug assembly and the exemplary setting tool of FIG. 1.

Referring now to the drawings, and in particular to FIGS. 1 and 2, an exemplary plug assembly 10, such as for use as a frac plug when deployed into a casing 100 within a drilled hole, is shown in conjunction with a setting tool 12, in which the plug assembly 10 is in an initial state. In some implementations, the plug assembly 10 may comprise a tubular metal seal 14 having a proximal end 16 and a distal end 18. The plug assembly 10 may further comprise a frustoconical tube 20 having a first end 22 and a second end 24. The first end 22 of the frustoconical tube 20 may be in contact with the distal end 18 of the tubular metal seal 14. The plug assembly 10 may have a longitudinal axis L.

The plug assembly 10 may further comprise a slip member 30 having one or more slip segments 32. The slip member 30 may be positioned at least partially around the second end 24 of the frustoconical tube 20, such that the slip segments 32 are pushed outwardly when the second end 24 of the frustoconical tube 20 moves longitudinally. The slip member 30 may have a sloped interior surface 33 configured to engage the second end 24 of the frustoconical tube 20.

The plug assembly 10 may further comprise a tubular mandrel 42 positioned longitudinally through the frustoconical tube 20.

The plug assembly 10 may further comprise an end cap 40 in contact with the slip member 30 and/or the second end 24 of the frustoconical tube 20 and/or the distal end 18 of the tubular metal seal 14 and/or the tubular mandrel 42.

The plug assembly 10 has an initial set of dimensions in an initial state, as illustrated in FIGS. 1, 2, 9, and 9A; a first set of dimensions in a first state, as illustrated in FIGS. 4, 5, 10, 10A, 11, and 11A; and a second set of dimensions in a second state, as illustrated in FIGS. 7, 7A, 12A, 13, and 13A.

Figure 3:
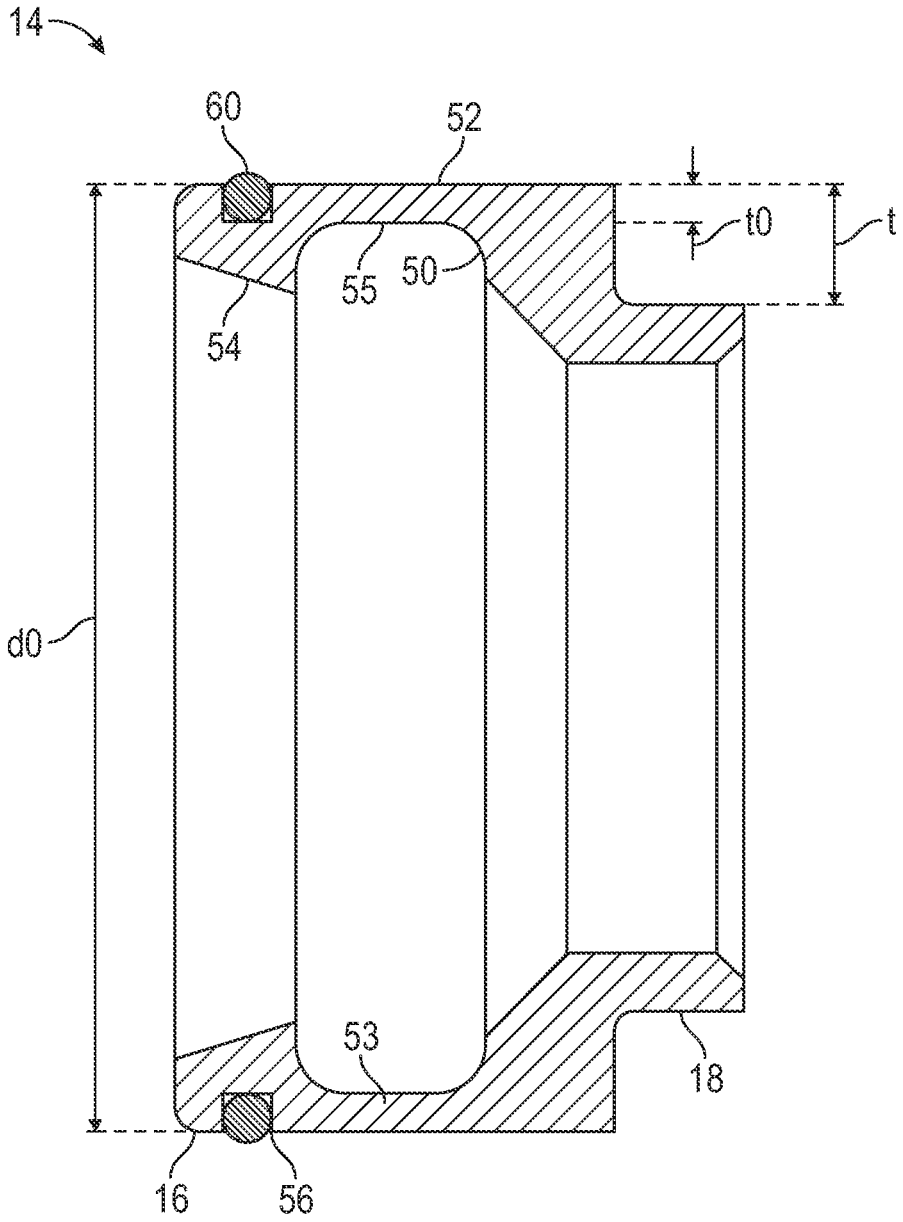
FIG. 3 is a cross-sectional view of an exemplary tubular metal seal of the exemplary plug assembly of FIG. 1.
Figure 4:
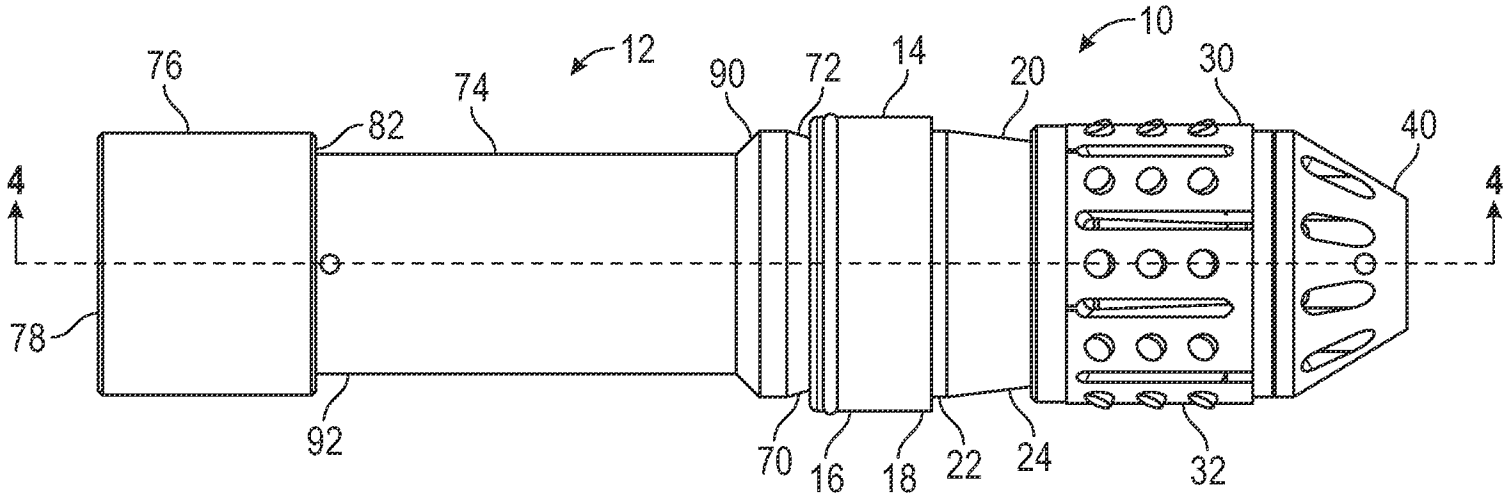
FIG. 4 is a side view of the exemplary plug assembly and the exemplary setting tool of FIG. 1, in which the plug assembly is in a first state, in accordance with the present disclosure.
Figure 6:
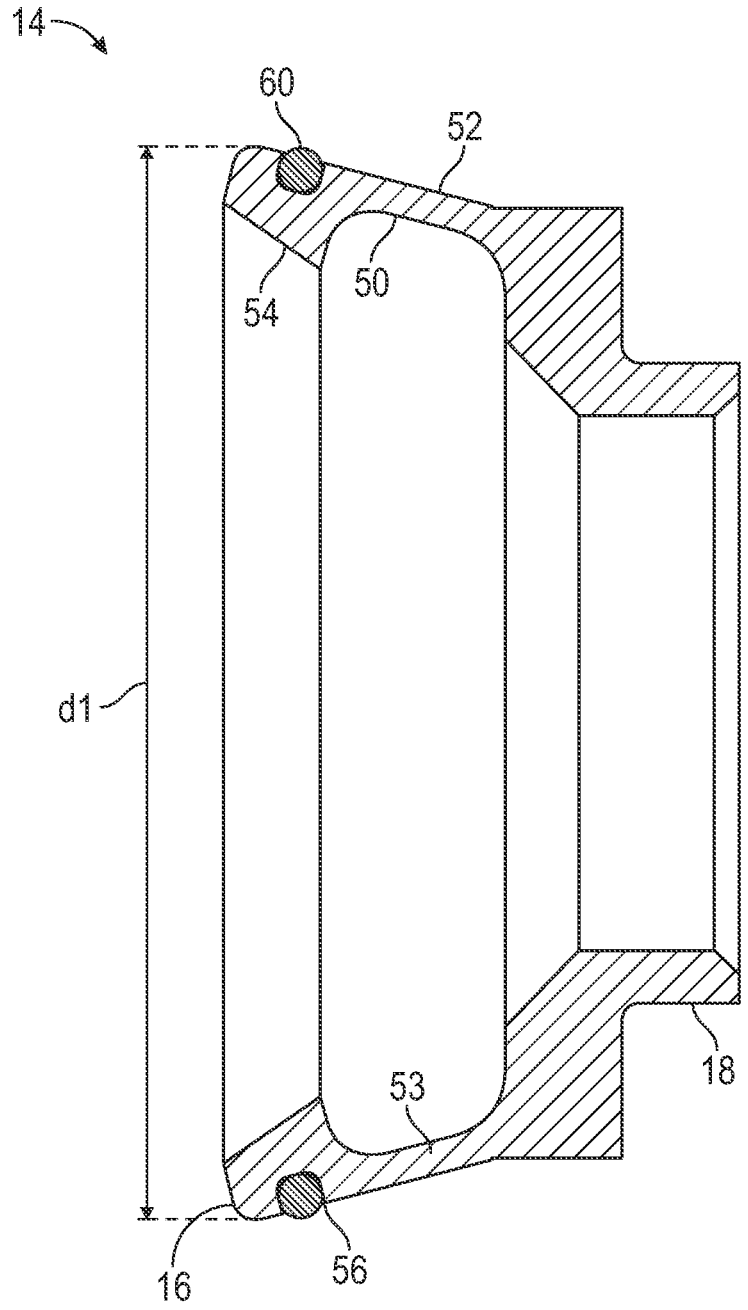
FIG. 6 is a cross-sectional view of an exemplary tubular metal seal of the exemplary plug assembly of FIG. 4.
Figure 7:
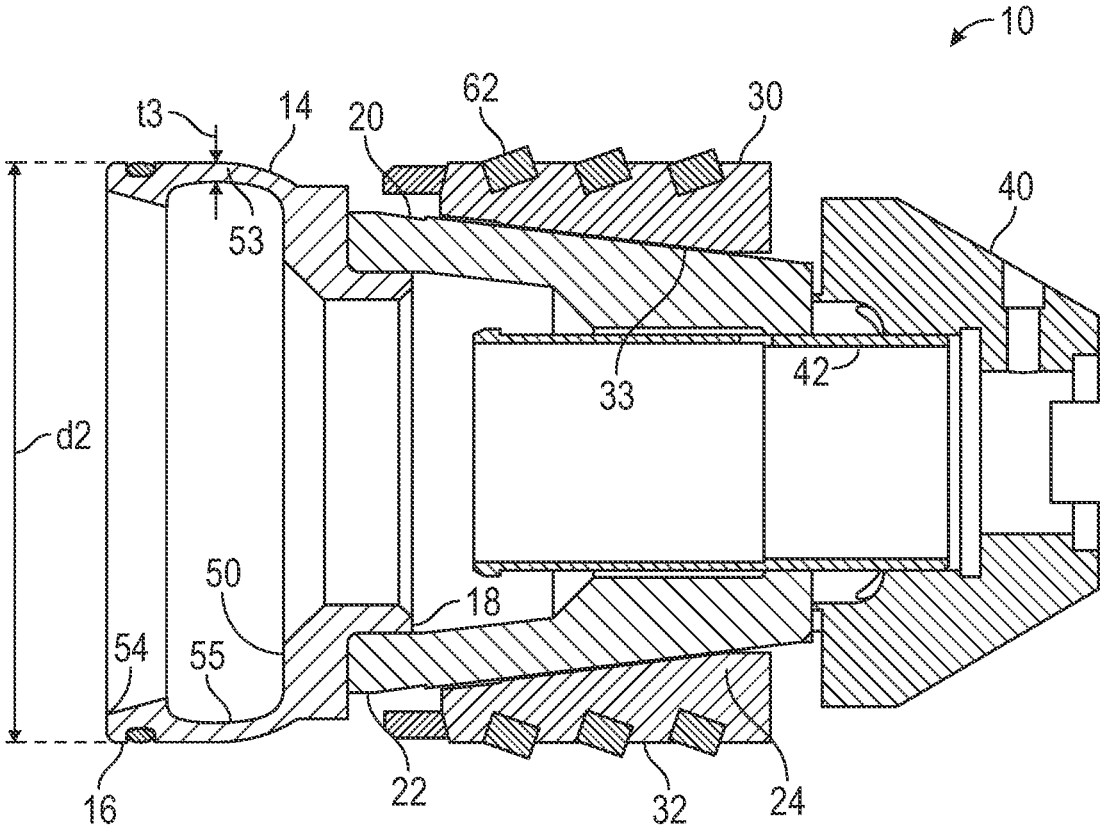
FIG. 7 is a cross-sectional view of the exemplary plug assembly in a second state in accordance with the present disclosure.
Figure 7A:
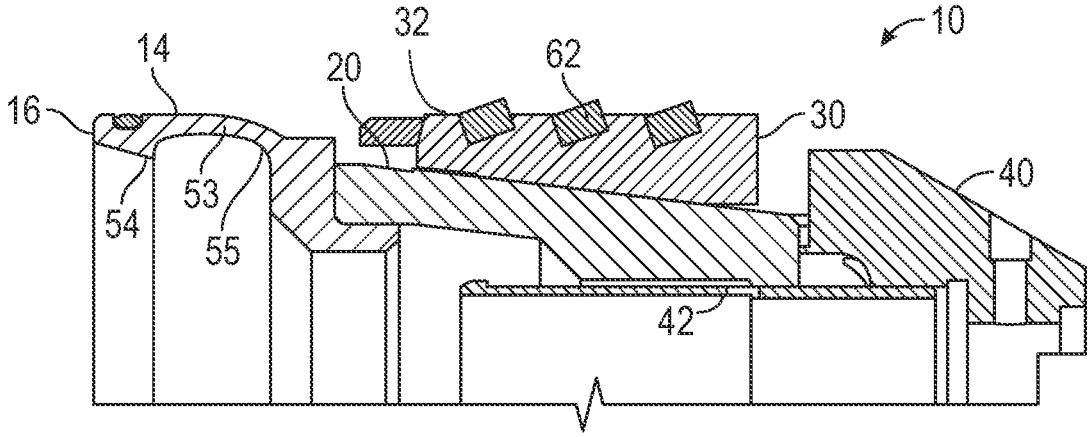
FIG. 7A is a partial view of the cross-section of FIG. 7.

The tubular metal seal 14 has an initial radial diameter d0 when the plug assembly 10 is in the initial state (FIG. 3), a first radial diameter d1 when the plug assembly 10 is in the first state (FIG. 6), and a second radial diameter d2 when the plug assembly 10 is in the second state (FIG. 7). The first radial diameter d1 is larger than the initial radial diameter d0. The second radial diameter d2 is larger than the first radial diameter d1. The tubular metal seal 14 may be deformed plastically to expand to the first radial diameter d1 and/or the second radial diameter d2. In some implementations, the tubular metal seal 14 may be deformed plastically to expand to the first radial diameter d1 and to a first external circumference, the first external circumference conformed to the interior of the casing 100. If the interior of the casing 100 has an irregular shape, the first external circumference may be an irregularly shaped circumference, formed by plastic deformation of the tubular metal seal in contact with the interior of the casing 100. In some implementations, the tubular metal seal 14 may be deformed plastically to expand to the second radial diameter d2 and to a second external circumference, the second external circumference conformed to the interior of the casing 100. If the interior of the casing 100 has an irregular shape, the second external circumference may be an irregularly shaped circumference, formed by plastic deformation of the tubular metal seal in contact with the interior of the casing 100.

The tubular metal seal 14 may be referred to as a flare seal. In some implementations, the tubular metal seal 14 has an interior 50 and an exterior 52 and a sidewall 53 extending between the interior 50 and the exterior 52. The interior 50 at the proximal end 16 may have a tapered interior portion 54 extending inwardly toward the distal end 18. In some implementations, the tapered interior portion 54 may have an angle of approximately fifteen degrees to approximately twenty degrees. In some implementations, the tapered interior portion 54 may have an angle of approximately seventeen degrees.

In some implementations, the tubular metal seal 14 may have an interior groove 55 in the interior 50 of the metal seal 14, or may have a cavity in the sidewall 53 or other narrowing of the sidewall 53. In some implementations, the interior groove 55 may be a radial groove in the interior 50 of the metal seal 14, having a radial diameter that is greater than the diameter of the remainder of the interior 50 of the metal seal 14, such that the sidewall 53 at the interior groove 55 has an initial thickness t0 less than the thickness(s) of other portions of the sidewall 53 of the metal seal 14. In some implementations, the interior groove 55 may be a radial groove in the interior 50 of the metal seal 14, having a diameter that is greater than the diameter of the tapered interior portion 54 of the metal seal 14, such that the sidewall 53 at the interior groove 55 has an initial thickness t0 less than the thickness(s) of the sidewall 53 of the tapered interior portion 54 of the metal seal 14. The interior groove 55 may be a radial groove extending about the diameter of the interior 50, or the cavity or other narrowing of the sidewall 53, may be configured such that the sidewall 53 expands radially and/or is deformed at the interior groove 55 when radial pressure is applied, such that the tubular metal seal 14 reaches the second radial diameter d2 (FIG. 7).

The tubular metal seal 14 may be partially or completely formed of a metal having a low modulus of elasticity such that the metal stretches, expands, and/or conforms to the casing 100 when the plug assembly 10 is in the second state and/or the third state, such that the sidewall 53 has an expanded thickness that is less that the initial thickness, for example, the sidewall 53 at the interior groove 55 may have an expanded thickness t3 that is less than the initial thickness t0 (FIG. 7). In some implementations, the tubular metal seal 14 may be formed of a metal having a ductility of approximately 12% maximum elongation to approximately 35% maximum elongation. In some implementations, the tubular metal seal 14 may be formed of a metal having a ductility of approximately 30% maximum elongation. In some implementations, the tubular metal seal 14 may be formed of a metal having a yield strength of approximately 30,000 psi. In some implementations, the tubular metal seal 14 may be formed of a metal having a yield strength of approximately 10,000 psi to approximately 30,000 psi. In some implementations, the tubular metal seal 14 may be formed of a metal having a yield strength of at least approximately 10,000 psi.

The tubular metal seal 14 may be partially or completely formed of a metal that expands when under a fluid pressure of less than approximately 4,000 psi. In some implementations, the tubular metal seal 14 may be partially or completely formed of a metal that expands when under a fluid pressure of less than approximately 3,000 psi. In some implementations, the tubular metal seal 14 may be partially or completely formed of a metal that expands when under to a fluid pressure of between approximately 3,000 psi and approximately 4,000 psi.

The tubular metal seal 14 may be partially or completely formed of a metal or metal alloy that is disintegrable in a downhole environment. In some implementations, the tubular metal seal 14 is partially or completely formed of a metal alloy having a composition that includes magnesium. In some implementations, the tubular metal seal 14 is formed of magnesium.

In some implementations, the plug assembly 10 may further comprise an elastomer seal 60 positioned radially on the exterior of the tubular metal seal 14. The elastomer seal 60 may be an O-ring or other gasket, for example. In some implementations, the exterior 52 of the tubular metal seal 14 may include a radial groove 56 around the exterior 52 of the plug assembly 10 and the elastomer seal 60 may be seated at least partially in the radial groove 56.

Figure 5:
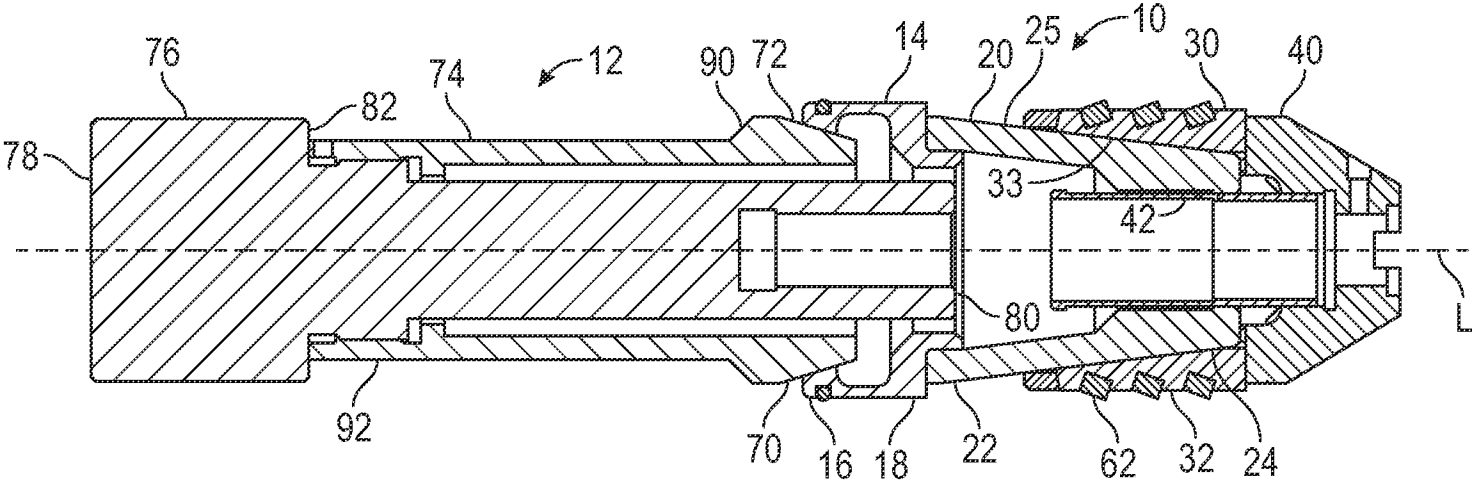
FIG. 5 is a cross-sectional view of the exemplary plug assembly and the exemplary setting tool of FIG. 4.

As illustrated in FIGS. 2 and 5, for example, in some implementations, the first end 22 of the frustoconical tube 20 of the plug assembly 10 may have a first outer diameter and the second end 24 of the frustoconical tube 20 may have a second outer diameter smaller than the first outer diameter. The frustoconical tube 20 may have a sloped exterior 25 at the second end 24. The sloped exterior 25 of the frustoconical tube 20 may be engageable with the sloped interior surface 33 of the slip member 30, such that when the sloped exterior 25 moves longitudinally along the sloped interior surface 33 of the slip member 30, the slip segments 32 are radially expanded outward by the frustoconical tube 20.

In some implementations, the slip member 30 may be plastic, metal, or a combination thereof. In some implementations, the slip segments 32 of the slip member 30 may optionally have one or more grips 62 protruding externally from and/or through the slip segments 32. Nonexclusive examples of the grips 62 include, teeth, buttons, and ridges. In some implementations, the grips 62 may be cylindrical and may have longitudinal axes set at an angle to the longitudinal axis L of the plug assembly 10.

The setting tool 12 may have a first end 70 having a tapered exterior portion 72. The tapered exterior portion 72 of the first end 70 of the setting tool 12 may be engageable with the tapered interior portion 54 of the proximal end 16 of the tubular metal seal 14, such that longitudinally advancing the setting tool 12 radially expands the proximal end 16 of the tubular metal seal 14 outwardly from an initial set of dimensions (FIG. 3) having the initial diameter d0 to the first set of dimensions (FIG. 6) having the first diameter d1 larger than the initial diameter d0. In some implementations, the angle of the tapered interior portion 54 may be determined so as to engage with the tapered exterior portion 72 of the first end 70 of the setting tool 12.

In some implementations, longitudinally advancing the setting tool 12 radially expands the tubular metal seal 14 outwardly from an initial set of dimensions (FIG. 3) having the initial diameter d0 to the second set of dimensions (FIG. 7) having the second diameter d2 larger than the initial diameter d0.

In some implementations, the setting tool 12 may comprise a setting sleeve 74 and a tension mandrel 76. The tension mandrel 76 may have a proximal end 78 having a first diameter, a distal end 80 having a second diameter smaller than the first diameter, and a step 82 between the proximal end 78 and the distal end 80. The setting sleeve 74 may be positioned about the distal end 80 of the tension mandrel 76. The setting sleeve 74 may have a first end 90, including the tapered exterior portion 72 of the first end 70 of the setting tool 12, and may have a second end 92 in contact with the step 82 of the tension mandrel 76.

In some implementations, the second end 92 of the setting sleeve 74 may have a maximum wall thickness that is greater than a maximum thickness of the sidewall 53 of the proximal end 16 of the metal seal 14. In other words, the maximum thickness of the sidewall 53 of the proximal end 16 of the metal seal 14 may be less than the maximum wall thickness of the second end 92 of the setting sleeve 74.

Figure 8:
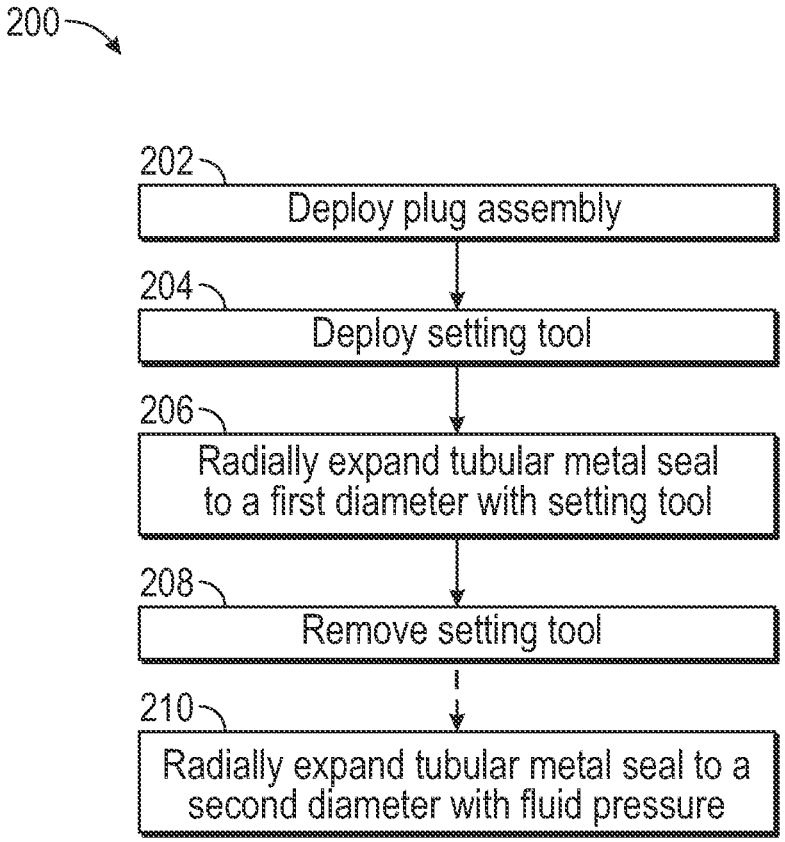
FIG. 8 is a process flow diagram of an exemplary method in accordance with the present disclosure.

As illustrated in FIG. 8, in use, a method 200 of setting the plug assembly 10 within a casing 100 in a drilled hole may comprise deploying the plug assembly 10 into the casing 100 (step 202); deploying the setting tool 12 into the casing (step 204); expanding the tubular metal seal 14 radially from the initial radial diameter d0 to the first radial diameter d1 with the setting tool 12 by moving the setting tool 12 longitudinally such that the tapered exterior portion 72 of the first end 70 of the setting tool 12 engages and expands the tapered interior portion 54 of the proximal end 16 of the tubular metal seal 14 (step 206); and removing the setting tool 12 from the casing 100 (step 208). In some implementations, expanding the tubular metal seal 14 radially from the initial radial diameter d0 comprises moving the setting tool 12 longitudinally such that the tapered exterior portion 72 of the first end 70 of the setting tool 12 engages the tapered interior portion 54 of the proximal end 16 of the tubular metal seal 14 and radially outwardly expands the sidewall 53 of the tubular metal seal 14.

In some implementations, the method 200 comprises expanding the tubular metal seal 14 radially to the second radial diameter d2 by pumping fluid 104 into the casing 100, the fluid 104 providing radial pressure against the interior 50 of the tubular metal seal 14, such that the exterior 52 of the tubular metal seal 14 engages (and/or sealingly conforms to) an interior 102 of the casing 100, thereby preventing fluid flow between the plug assembly 10 and the interior 102 of the casing 100 (step 210).

In some implementations, the method 200 further comprises moving the frustoconical tube 20 longitudinally with the setting tool 12, such as by transferred force through the tubular metal seal 14 and/or by direct contact of the setting tool 12 with the frustoconical tube 20. In some implementations, for example, the distal end 80 of the tension mandrel 76 of the setting tool 12 may be in contact with the first end 22 of the frustoconical tube 20 and may transfer longitudinal force to the frustoconical tube 20. The method 200 may further comprise moving the frustoconical tube 20 longitudinally within the one or more slip segments 32 of the slip member 30 by moving the setting tool 12 longitudinally, thereby expanding the one or more slip segments 32 outwardly. In some implementations, expanding the one or more slip segments 32 outwardly comprises expanding the one or more slip segments 32 outwardly until the grips 62 on the one or more slip segments 32 contact the interior 102 of the casing 100, causing a gripping force between the slip segments 32 and the interior 102 of the casing 100.

In some implementations, in step 206, expanding the tubular metal seal 14 radially from the initial radial diameter d0 to the first radial diameter d1 with the setting tool 12 by moving the setting tool 12 longitudinally such that the tapered exterior portion 72 of the first end 70 of the setting tool 12 engages the tapered interior portion 54 of the proximal end 16 of the tubular metal seal 14, may further comprise expanding the tubular metal seal 14 radially to the first radial diameter d1 with the setting tool 12 by moving the setting tool 12 longitudinally such that the tapered exterior portion 72 of the first end of the setting sleeve 74 of the setting tool 12 engages the tapered interior portion 54 of the proximal end 16 of the tubular metal seal 14, thereby radially expanding the proximal end 16 of the metal seal 14.

In some implementations, the method 200 may further comprise expanding the optional elastomer seal 60 on the exterior 52 of the tubular metal seal 14 as the tubular metal seal 14 radially expands, such that the elastomer seal 60 is in contact with the interior 102 of the casing 100.

In some implementations, in step 210, since the initial thickness t0 of the sidewall 53 of the metal seal 14 at the interior groove 55 (and/or other thin portion of the sidewall 53) is less than the thickness of the sidewall 53 elsewhere in the metal seal 14, then the sidewall 53 at the interior groove 55 deforms and/or expands first when fluid pressure is introduced, as it requires less pressure to expand the thinner part of the sidewall 53. The thickness t0 of the sidewall 53 and the material of the sidewall 53 of the metal seal 14 are configured to deform outwardly, like a balloon, and to conform to the interior 102 of the casing 100. In some implementations, the sidewall 53 at the interior groove 55 expands when under to a fluid pressure of less than approximately 4,000 psi. In some implementations, the sidewall 53 at the interior groove 55 expands when under a fluid pressure of less than approximately 3,000 psi. In some implementations, the sidewall 53 at the interior groove 55 expands when under to a fluid pressure of between approximately 3,000 psi and approximately 4,000 psi.

The exterior 52 of the expanded tubular metal seal 14 may provide a seal against the interior 102 of the casing 100 preventing fluid from moving between the interior 102 of the casing 100 and the plug assembly 10. The expanded tubular metal seal 14 may further provide a setting force which may hold (or assist in holding) the plug assembly 10 in place within the casing 100.

In some implementations, the method 200 may not include step 206. Instead, the metal seal 14 may be expanded by fluid pressure from the initial radial diameter d0 until the metal seal 14 is radially expanded to the second radial diameter d2, thereby sealing the plug assembly 10 against the interior 102 of the casing 100.

In some implementations, the method 200 may include another step after step 210, in which, once the metal seal 14 is radially expanded to the second radial diameter d2, the fluid pressure acts on the metal seal 14 to transmit longitudinal force to the frustoconical tube 20 which moves the frustoconical tube 20 longitudinally, thereby transmitting further radial forces into the slip segments 32, increasing the force of the slip segments 32 and/or the grips 62 against the interior 102 of the casing, and further securing the plug assembly 10 in the casing 100.

An example of the method 200 in use will now be described in relation to FIGS. 9-13A. It will be understood that FIGS. 9-13A have been drawn to illustrate the method 200, but that gaps shown between the interior 102 of the casing 100 and the plug assembly 10 and schematic illustrations in the cross-sectional drawings are for explanatory purposes and may or may not exist and may not be drawn to scale.

Figure 9A:
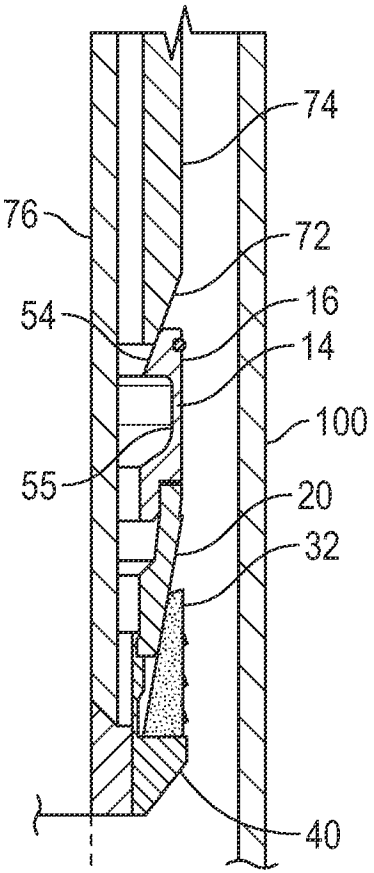
FIG. 9A is a partial cross-sectional view of the exemplary plug assembly and the exemplary setting tool deployed in the downhole casing of FIG. 9.
Figure 9:
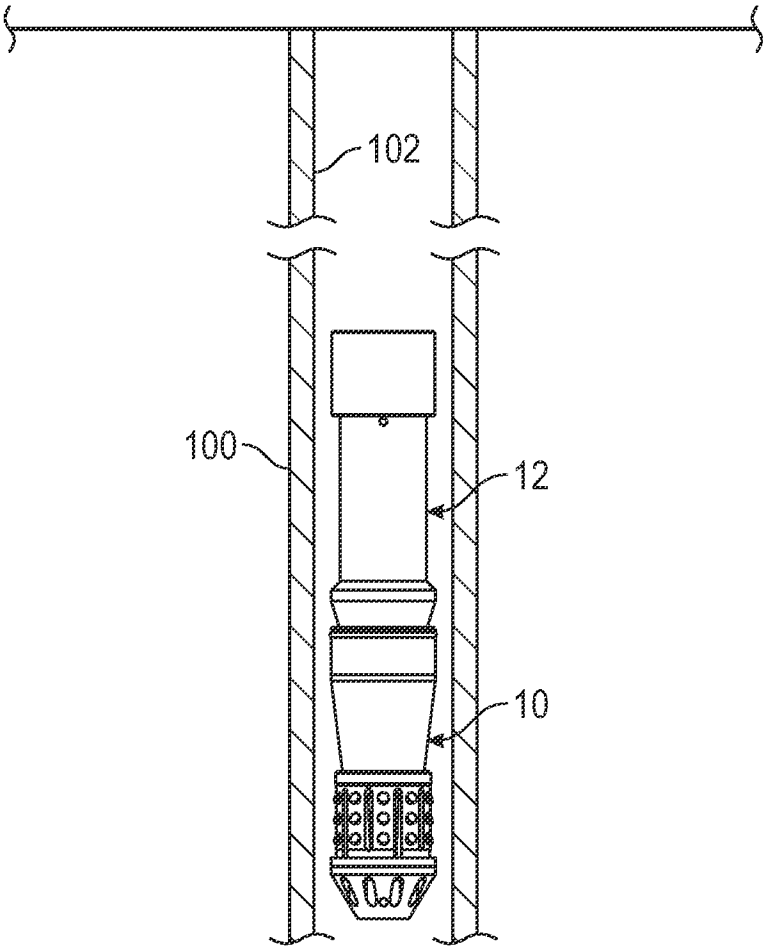
FIG. 9 is a side view of the exemplary plug assembly and the exemplary setting tool of FIG. 1 deployed in a downhole casing in accordance with the present disclosure.

FIG. 9 illustrates the plug assembly 10 and the setting tool 12 being deployed in the casing 100 as in steps 202 and 204 of the method 200. The plug assembly 10 and/or the setting tool 12 may be moved through the casing hydraulically, mechanically, electrically, and/or magnetically. The plug assembly 10 and/or the setting tool 12 may be disposed on, or with, a drill string. As shown in FIGS. 9 and 9A, during deployment (and, in some implementations, until completion of step 206), the plug assembly 10 may be in the initial state with the initial set of dimensions, including the tubular metal seal 14 having the initial radial diameter d0 and the sidewall 53 (such as at the interior groove 55) having the initial thickness to.

Figure 10A:
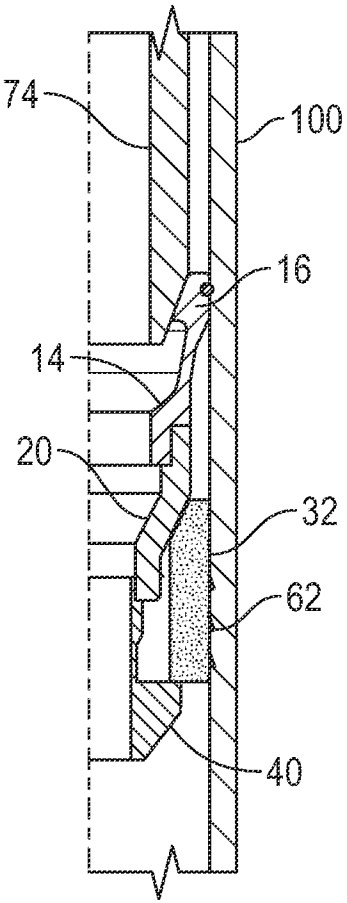
FIG. 10A is a partial cross-sectional view of the exemplary plug assembly and the exemplary setting tool deployed in the downhole casing of FIG. 10.
Figure 10:
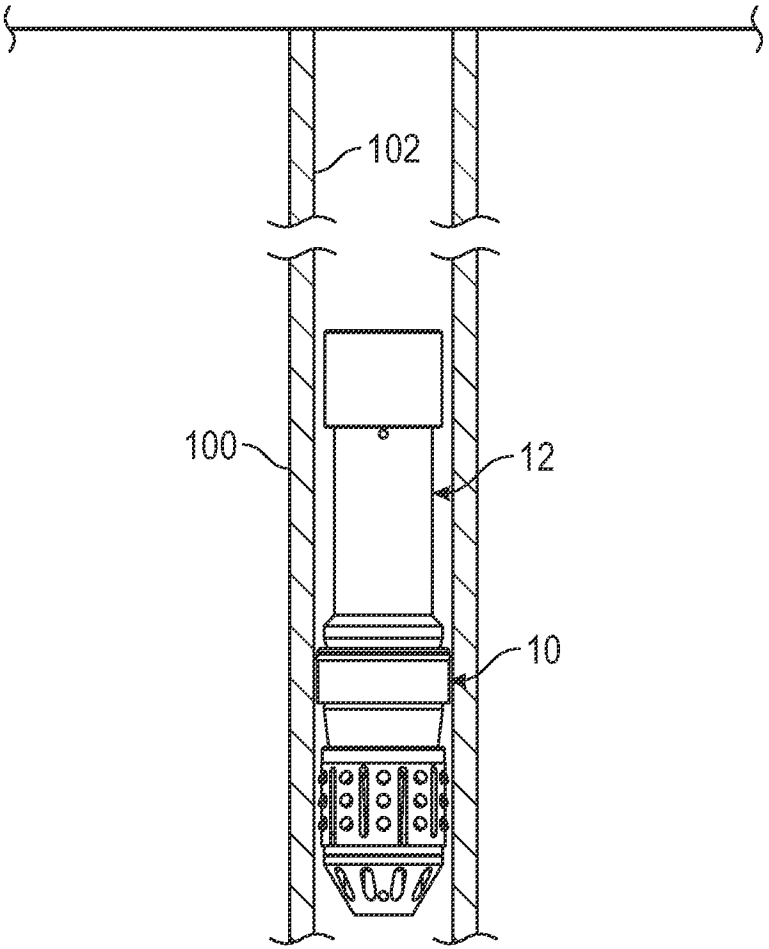
FIG. 10 is a side view of the exemplary plug assembly and the exemplary setting tool of FIG. 4 deployed in a downhole casing in accordance with the present disclosure.

FIGS. 10 and 10A illustrate the plug assembly 10 in the first state having the first dimensions within the casing 100, after the setting tool 12 has radially expanded the tubular metal seal 14 to the first diameter d1 in step 206. In the first state, at least the proximal end 16 of the metal seal 14 may be radially expanded by the force of the setting sleeve 74 as it moves longitudinally and engages the tapered interior portion 54 of the proximal end 16 of the metal seal 14.

In the first state, the slip segments 32 of the slip member 30 may be expanded outwardly such that the slip segments 32 (and/or the grips 62, when present) are in contact with the interior 102 of the casing 100 and/or the optional elastomer seal 60 may be radially expanded and in contact with the interior 102 of the casing 100. At least while the plug assembly 10 is in the first state, the slip segments 32 and/or the grips 62 contact with the interior 102 of the casing 100 may maintain the position of the plug assembly 10 in the casing 100. Additionally, in the first state, the elastomer seal 60 may temporarily slow or stop fluid flow between the plug assembly 10 and the interior 102 of the casing 100. However, it will be understood that the slip member 30 and/or the elastomer seal 60 may be eliminated and the tubular metal seal 14 may hold the plug assembly 10 in place in the casing 100 and/or create a fluid-impervious seal between the plug assembly 10 and the interior 102 of the casing 100, such as when the plug assembly 10 is in the second state.

Figure 11A:
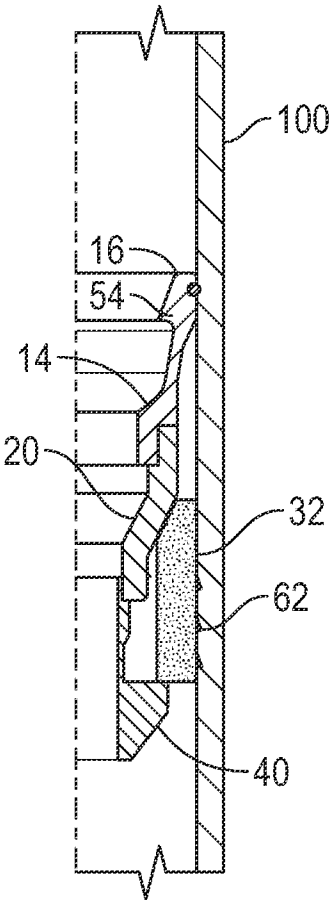
FIG. 11A is a partial cross-sectional view of the exemplary plug assembly deployed in the downhole casing of FIG. 11.
Figure 11:
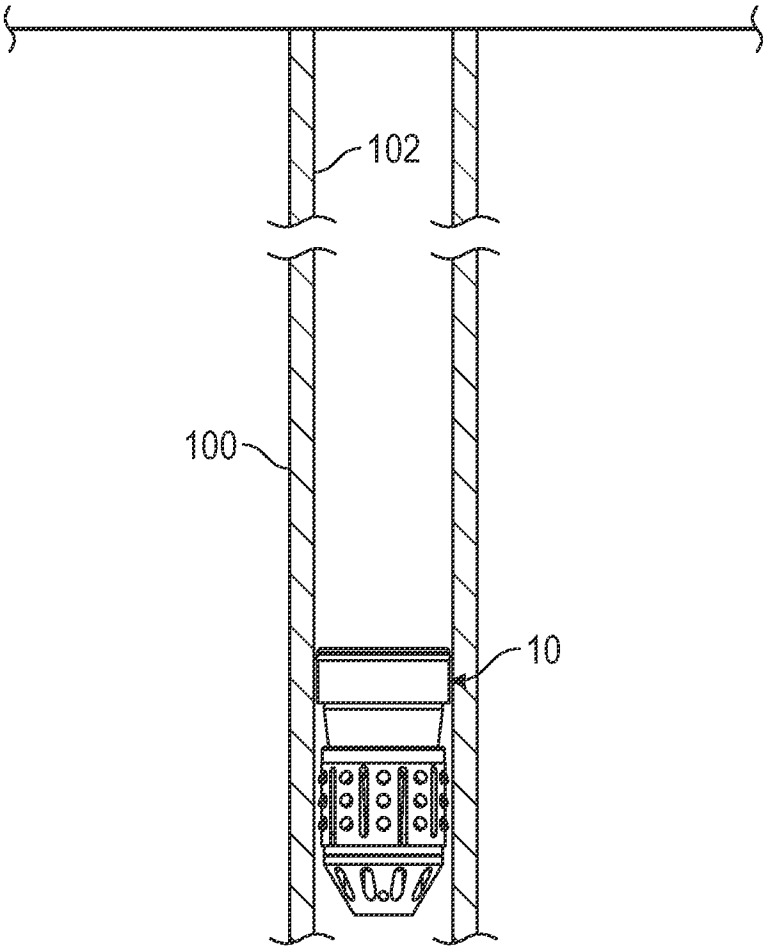
FIG. 11 is a side view of the exemplary plug assembly in the first state deployed in a downhole casing in accordance with the present disclosure.

FIGS. 11 and 11A illustrate the plug assembly 10 positioned in the casing 100 in the first state, with the tubular metal seal 14 expanded to the first diameter d1, after the setting tool 12 has been removed in step 208.

Figure 12A:
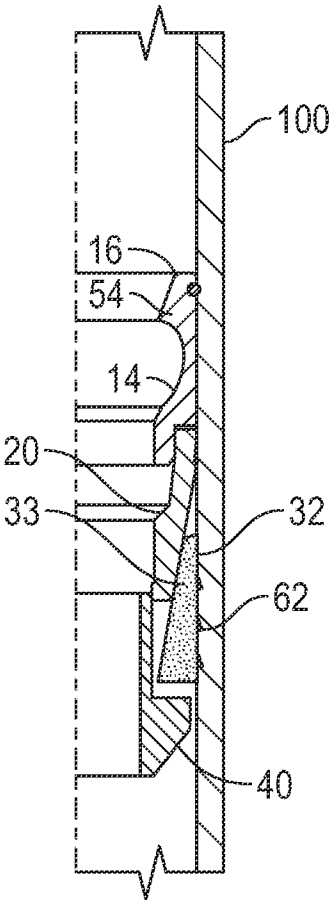
FIG. 12A is a partial cross-sectional view of the exemplary plug assembly deployed in the downhole casing of FIG. 12.
Figure 12:
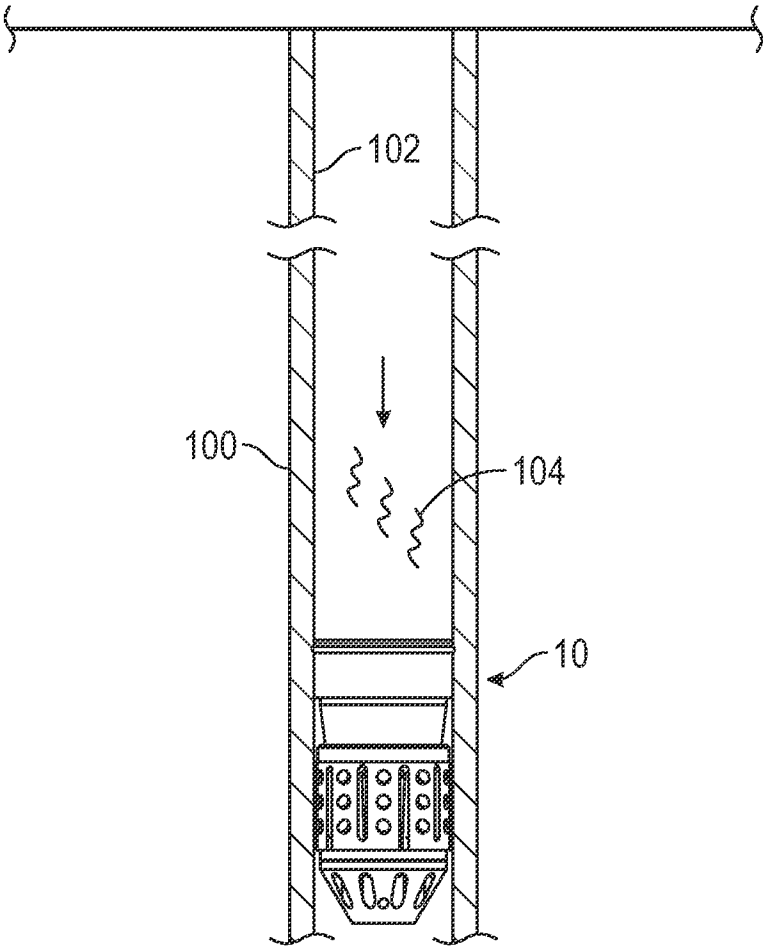
FIG. 12 is a side view of the exemplary plug assembly in the second state deployed in a downhole casing in accordance with the present disclosure.
Figure 13:
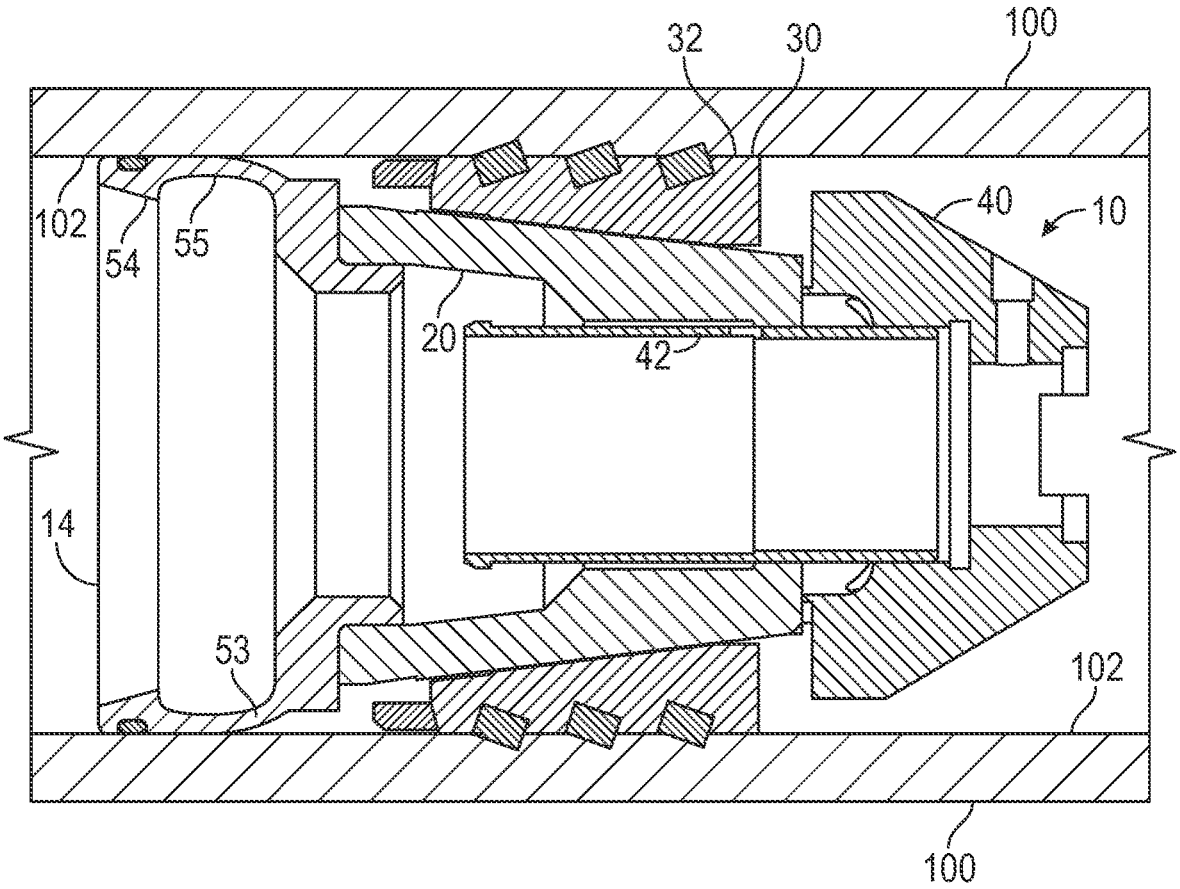
FIG. 13 is a cross-sectional view of the exemplary plug assembly in the second state deployed in a downhole casing in accordance with the present disclosure.
Figure 13A:
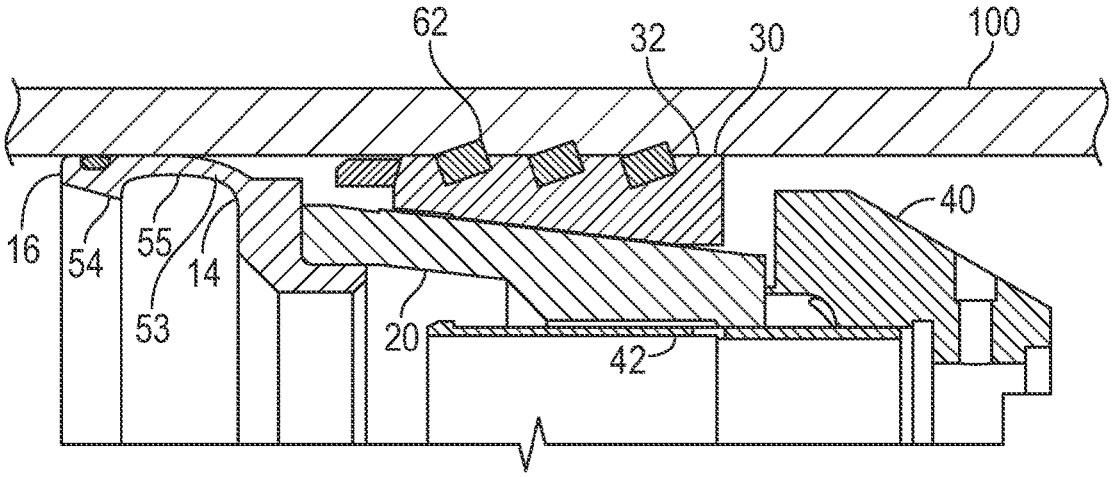
FIG. 13A is a partial cross-sectional view of the exemplary plug assembly deployed in the downhole casing of FIG. 13.

FIGS. 12-13A illustrate the plug assembly 10 in the casing 100 in the second state, after step 210, in which the tubular metal seal 14 is radially expanded to the second radial diameter d2, such as by pumping fluid 104 into the casing 100, the fluid 104 providing radial pressure against the interior 50 of the tubular metal seal 14, such that the exterior 52 of the tubular metal seal 14 engages (and/or sealingly conforms to) the interior 102 of the casing 100, thereby preventing fluid flow past the exterior 52 of the tubular metal seal 14 and the interior 102 of the casing 100. The expanded tubular metal seal 14 may further provide a setting force which may hold (or assist in holding) the plug assembly 10 in place within the casing 100.

In some implementations, portions or all of the plug assembly 10 may be structured to disintegrate after a predetermined amount of time exposed to the fluid 104 in the casing 100. Portions or all of the plug assembly 10 may be manufactured from metal, metal alloys, or other materials that disintegrate after a predetermined amount of time exposed to the fluid 104 in the casing 100.

Figure 14:
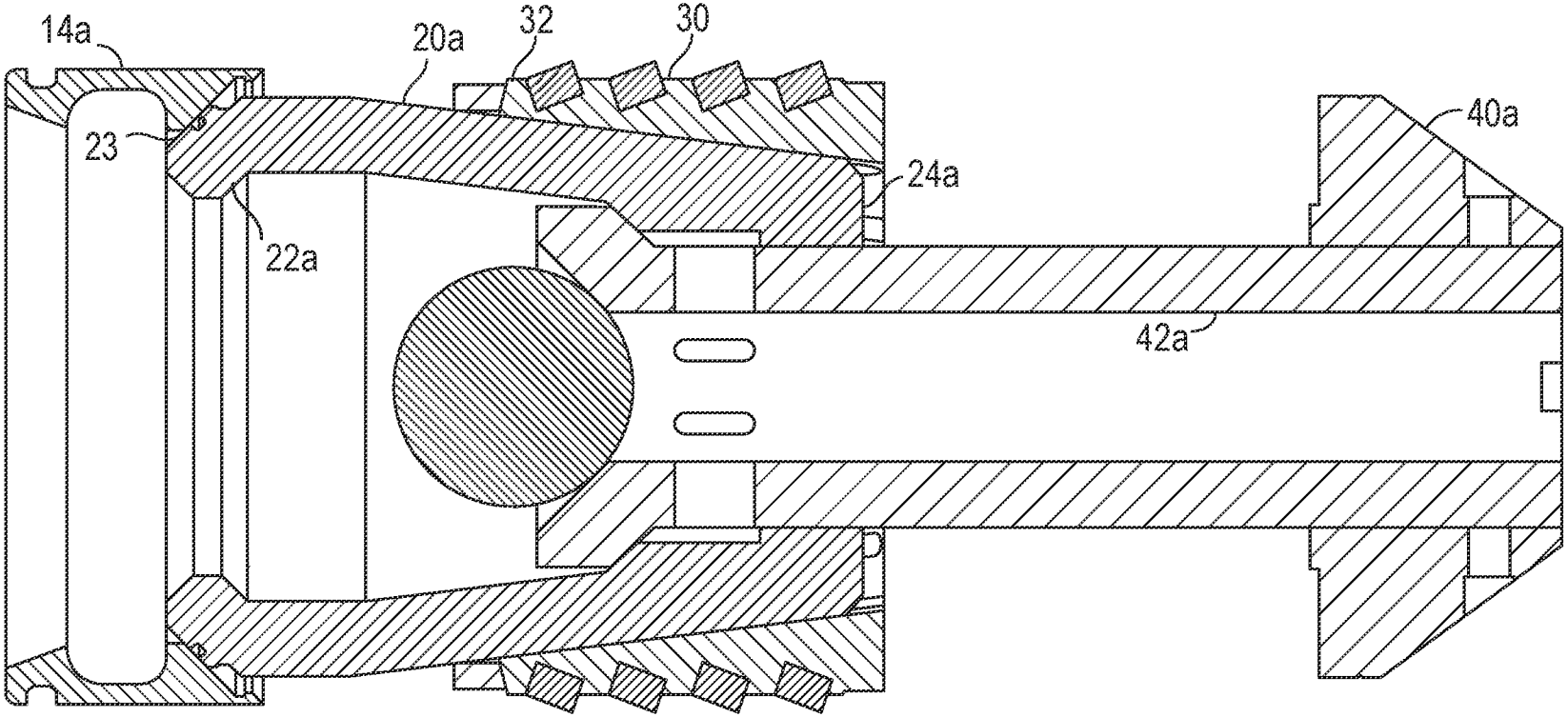
FIG. 14 is a cross-sectional view of another exemplary plug assembly, in accordance with the present disclosure.
Figure 15:
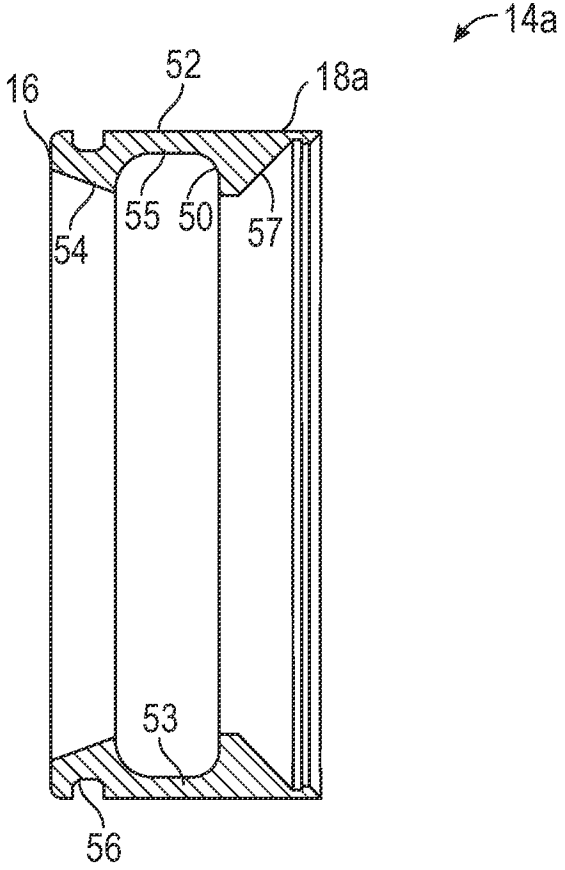
FIG. 15 is a cross-sectional view of an exemplary tubular metal seal of the plug assembly of FIG. 14.

FIGS. 14 and 15 illustrate another embodiment of a plug assembly 10*a* constructed in accordance with the inventive concepts disclosed herein. The plug assembly 10*a* is substantially similar to the plug assembly 10, except as described herein below, and may be used in the method 200.

The plug assembly 10*a* may comprise a tubular metal seal 14*a* having a proximal end 16 and a distal end 18*a*. In the implementation shown in FIGS. 14 and 15, the tapered interior portion 54 is a first tapered interior portion 54, and the distal end 18*a* of the tubular metal seal 14*a* has a second tapered interior portion 57 extending inwardly from the distal end 18*a* toward the proximal end 16. The second tapered interior portion 57 may have an angle that is equal to, more than, or less than the angle of the first tapered interior portion 54. In the example shown, the second tapered interior portion 57 has a more acute angle than the angle of the first tapered interior portion 54.

The plug assembly 10*a* may further comprise a frustoconical tube 20*a* having a first end 22*a* and a second end 24*a*. The first end 22*a* of the frustoconical tube 20*a* may be in contact with the distal end 18*a* of the tubular metal seal 14*a*, such as with the interior of the distal end 18*a*. The first end 22*a* of the frustoconical tube 20*a* may have an exterior tapered portion 23 having an angle that is substantially complimentary to the angle of the second tapered portion 57, while allowing the second tapered portion 57 of the tubular metal seal 14*a* and the exterior tapered portion 23 of the frustoconical tube 20*a* to moveably engage one another.

The second tapered portion 57 of the tubular metal seal 14*a* may engage with the exterior tapered portion 23, radially expanding the tubular metal seal 14*a*, when force from the setting sleeve 74, as it moves longitudinally and engages the tapered interior portion 54 of the proximal end 16 of the tubular metal seal 14*a*, is transferred through the tubular metal seal 14*a*. And/or the second tapered portion 57 of the tubular metal seal 14*a* may engage with the exterior tapered portion 23, radially expanding the tubular metal seal 14*a*, when fluid pressure is applied. The tubular metal seal 14 may be deformed plastically to expand to the first radial diameter d1 and/or the second radial diameter d2 and/or to conform to the interior 102 of the casing 100.

The plug assembly 10 may further comprise the slip member 30 having the one or more slip segments 32. The slip member 30 may be positioned at least partially around the second end 24*a* of the frustoconical tube 20*a*, such that the slip segments 32 are pushed outwardly when the second end 24 of the frustoconical tube 20*a* moves longitudinally. The slip member 30 may have a sloped interior surface 33 configured to engage the second end 24*a* of the frustoconical tube 20.

The plug assembly 10 may further comprise a tubular mandrel 42*a* positioned longitudinally through the frustoconical tube 20*a*. Though a particular tubular mandrel 42*a* is shown in this implementation in FIG. 14, it will be understood that other tubular mandrels may be utilized.

The plug assembly 10*a* may further comprise an end cap 40*a* in contact with the slip member 30 and/or the second end 24*a* of the frustoconical tube 20*a* and/or the distal end 18*a* of the tubular metal seal 14*a* and/or the tubular mandrel 42*a*.

In some implementations, the plug assembly 10, 10*a* and/or the tubular metal seal 14, 14*a* may be used in conjunction with and/or combined with elements of the systems and methods describe in the U.S. patent application entitled "Systems and Methods for Flow-Activated Initiation of Plug Assembly Flow Seats," having Ser. No. 17/405,690, filed Aug. 18, 2021, the entire contents of which are hereby incorporated herein.

CONCLUSION

Conventionally, setting plugs, such as frac plugs, in downhole applications has been time consuming and costly and the resulting seals were undependable. In accordance with the present disclosure, a plug assembly is set and sealed in a casing using a tubular metal seal. The tubular metal seal may be deformed using radial force from pressurized fluid and/or longitudinal force from a setting tool to set and seal the plug assembly within the casing.

The foregoing description provides illustration and description, but is not intended to be exhaustive or to limit the inventive concepts to the precise form disclosed. Modifications and variations are possible in light of the above teachings or may be acquired from practice of the methodologies set forth in the present disclosure.

Even though particular combinations of features are recited in the claims and/or disclosed in the specification, these combinations are not intended to limit the disclosure. In fact, many of these features may be combined in ways not specifically recited in the claims and/or disclosed in the specification. Although each dependent claim listed below may directly depend on only one other claim, the disclosure includes each dependent claim in combination with every other claim in the claim set.

No element, act, or instruction used in the present application should be construed as critical or essential to the invention unless explicitly described as such outside of the preferred embodiment. Further, the phrase "based on" is intended to mean "based, at least in part, on" unless explicitly stated otherwise.

What is claimed is:

1. A method, comprising:

deploying a plug assembly into a casing within a drilled hole, the plug assembly comprising a tubular metal seal having an interior, an exterior, a sidewall extending between the interior and the exterior, a proximal end, a distal end, and a length extending between the proximal end and the distal end, the interior at the proximal end having a tapered interior portion extending inwardly toward the distal end along the length;

deploying a setting tool into the casing within the drilled hole, the setting tool having a first end having a tapered exterior portion;

expanding the tubular metal seal radially to a first radial diameter with the setting tool by moving the setting tool longitudinally such that the tapered exterior portion of the first end of the setting tool engages the tapered interior portion of the proximal end of the tubular metal seal;

expanding the tubular metal seal radially to a second radial diameter, such that the exterior of the tubular metal seal engages an interior of the casing, by pumping fluid into the casing, the fluid providing radial pressure against the interior of the tubular metal seal, thereby preventing fluid flow past the exterior of the tubular metal seal in the casing; and removing the setting tool from the casing.

2. The method of claim 1, wherein expanding the tubular metal seal radially to the first radial diameter comprises plastically deforming at least the proximal end of the tubular metal seal with the setting tool and thereby conforming at least the proximal end of the tubular metal seal to the interior of the casing.

3. The method of claim 1, wherein the interior of the casing has an irregular shape, and wherein expanding the tubular metal seal radially to the first radial diameter, comprises expanding the tubular metal seal radially such that the tubular metal seal has an irregularly shaped circumference conforming to the irregular shape of the interior of the casing.

4. The method of claim 1, wherein the tubular metal seal has a radial interior groove in the sidewall extending about the interior.

5. The method of claim 4, further comprising:

expanding the tubular metal seal radially to a second radial diameter and plastically deforming the sidewall at the radial interior groove of the tubular metal seal, such that the exterior of the tubular metal seal engages an interior of the casing, by pumping fluid into the casing, the fluid providing radial pressure against the interior of the tubular metal seal, thereby preventing fluid flow past the exterior of the tubular metal seal in the casing.

6. The method of claim 4, wherein the interior of the casing has an irregular shape, and wherein expanding the tubular metal seal radially to the second radial diameter comprises expanding the tubular metal seal radially such that the tubular metal seal has an irregularly shaped circumference conforming to the irregular shape of the interior of the casing.

7. The method of claim 4, wherein expanding the tubular metal seal radially to the second radial diameter comprises conforming the tubular metal seal to the interior of the casing.

8. The method of claim 1, wherein the plug assembly further comprises an elastomer seal positioned on the exterior of the tubular metal seal.

9. The method of claim 8, wherein expanding the tubular metal seal radially to the first radial diameter further comprises expanding the elastomer seal on the exterior of the tubular metal seal as the tubular metal seal radially expands such that the elastomer seal is in contact with the casing.

10. The method of claim 1, wherein the plug assembly further comprises a frustoconical tube having a first end in contact with the distal end of the tubular metal seal, wherein the first end of the frustoconical tube has a first diameter and the frustoconical tube has a second end having a second diameter smaller than the first diameter.

11. The method of claim 10, wherein the plug assembly further comprises a slip member having one or more slip segments positioned at least partially around the second end of the frustoconical tube; and the method further comprises:

increasing an outward radial force on the one or more slip segments by applying fluid pressure until after the tubular metal seal is fully expanded, such that the fluid pressure creates a longitudinal force between the tubular metal seal which is transmitted via an engagement between the frustoconical tube and the slip member into the outward radial force on the one or more slip segments.

12. The method of claim 10, wherein the plug assembly further comprises a slip member having one or more slip segments positioned at least partially around the second end of the frustoconical tube; and wherein the method further comprises:

moving the frustoconical tube longitudinally within the one or more slip segments by moving the setting tool longitudinally, thereby expanding the one or more slip segments outwardly.

13. The method of claim 12, wherein moving the frustoconical tube longitudinally by moving the setting tool longitudinally further comprises moving the frustoconical tube longitudinally with the setting tool via transferred force through the tubular metal seal.

14. The method of claim 12, wherein expanding the one or more slip segments outwardly comprises expanding the one or more slip segments outwardly until grips on the one or more slip segments contact the casing.

15. The method of claim 10, wherein the plug assembly further comprises:

a slip member having one or more slip segments positioned at least partially around the second end of the frustoconical tube; and an end cap in contact with the slip member.

16. The method of claim 1, wherein the setting tool further comprises:

a tension mandrel having a proximal end having a first diameter, a distal end having a second diameter smaller than the first diameter, and a step between the proximal end and the distal end, wherein the distal end is initially in contact with the tubular metal seal; and a setting sleeve positioned around the distal end of the tension mandrel, the setting sleeve having a first end including the tapered exterior portion of the setting tool and having a second end in contact with the step of the tension mandrel.

17. A plug assembly deployable into a casing in a drilled hole, comprising:

a tubular metal seal having an interior, an exterior, a proximal end, a distal end, a length extending between the proximal end and the distal end, and a sidewall extending between the interior and the exterior, the interior having a tapered portion extending inwardly along the length toward the distal end, the interior having a radial interior groove located between the tapered portion and the distal end;

wherein the tubular metal seal is radially expandable to a first radial diameter by moving a setting tool longitudinally such that a tapered exterior portion of a first end of the setting tool engages the tapered portion of the interior of the proximal end of the tubular metal seal, thereby radially deforming the tubular metal seal; and wherein the tubular metal seal is radially expandable to a second radial diameter larger than the first radial diameter by pumping fluid into the casing, the fluid providing radial pressure against the interior of the tubular metal seal, thereby further outwardly radially deforming the tubular metal seal, such that the exterior of the tubular metal seal engages an interior of the casing, preventing fluid flow past the exterior of the tubular metal seal in the casing.

18. The plug assembly of claim 17, the tubular metal seal having a radial interior groove extending about the interior, and wherein deforming the tubular metal seal includes deforming at least the tapered portion of the interior of the proximal end and the sidewall at the radial interior groove of the tubular metal seal to conform to the interior of the casing.

* * * * *